US006898906B2

(12) United States Patent
Drost

(10) Patent No.: US 6,898,906 B2
(45) Date of Patent: May 31, 2005

(54) FLOOR COVERING ELEMENT CONSISTING OF ARTIFICIAL STONE MATERIAL AND SET OF FLOOR COVERING ELEMENTS

(76) Inventor: Andreas Drost, Moninger Strasse 18, D-76135 Karlsruhe (DE)

( * ) Notice: Subject to any disclaimer, the term of this patent is extended or adjusted under 35 U.S.C. 154(b) by 0 days.

(21) Appl. No.: 10/381,675

(22) PCT Filed: Sep. 24, 2001

(86) PCT No.: PCT/DE01/11032

§ 371 (c)(1),
(2), (4) Date: Mar. 27, 2003

(87) PCT Pub. No.: WO02/27100

PCT Pub. Date: Apr. 4, 2002

(65) Prior Publication Data

US 2004/0045248 A1 Mar. 11, 2004

(30) Foreign Application Priority Data

Sep. 27, 2000 (DE) ..... 200 16 731 U

(51) Int. Cl.[7] ..... E04F 15/00; E01C 5/00

(52) U.S. Cl. ..... 52/177; 52/604; 52/608; 404/41; 404/42

(58) Field of Search ..... 52/177, 574, 603, 52/604, 608, 609; 404/34, 41, 42

(56) References Cited

U.S. PATENT DOCUMENTS

| | | | | | |
|---|---|---|---|---|---|
| 1,474,779 | A | * | 11/1923 | Kammer | 52/311.2 |
| 3,494,266 | A | * | 2/1970 | Baumberger | 404/41 |
| 3,903,702 | A | * | 9/1975 | Appleton | 405/20 |
| 3,923,410 | A | * | 12/1975 | Jordan et al. | 404/41 |
| 3,947,192 | A | * | 3/1976 | Rosenberger | 404/41 |
| 4,354,773 | A | * | 10/1982 | Noack | 404/41 |
| 4,919,565 | A | * | 4/1990 | Gopfert | 404/41 |
| 5,884,445 | A | * | 3/1999 | Woolford | 52/311.2 |
| 5,887,846 | A | * | 3/1999 | Hupp | 249/2 |
| 6,079,902 | A | * | 6/2000 | Pettee, Jr. | 405/35 |
| 2001/0041092 | A1 | * | 11/2001 | Gopfert | 404/41 |

FOREIGN PATENT DOCUMENTS

| | | |
|---|---|---|
| DE | 15 34 423 A1 | 6/1969 |
| DE | 15 34 428 A | 9/1969 |
| DE | 69 37 946 U1 | 2/1970 |
| DE | 24 04 517 A1 | 8/1975 |
| DE | 27 13 354 A1 | 10/1977 |
| DE | 80 07 128 U1 | 6/1980 |
| DE | 80 23 208 U1 | 11/1980 |
| DE | 31 48 779 A1 | 8/1982 |
| DE | 85 08 701 U1 | 9/1985 |
| DE | 42 00 335 A1 | 1/1993 |
| DE | 29507957 U | 7/1995 |
| DE | 295 09 796 U | 12/1995 |
| DE | 297 02 544 U1 | 5/1997 |
| DE | 196 50 700 A1 | 6/1998 |
| FR | 2 294 814 A | 7/1976 |
| WO | 96 32538 A | 10/1996 |

* cited by examiner

*Primary Examiner*—Brian E. Glessner
(74) *Attorney, Agent, or Firm*—Venable LLP; Robert Kinberg

(57) ABSTRACT

A ground covering element having the basic shape of a square. All four basic sides of the around covering element have an engaging profile, each profile being symmetric with respect to a central axis of symmetry. Opposite engaging profiles are mirror images. Each engaging profile is complementary with the adjacent engaging profile. Each of the four corner regions of the ground covering element of a first type have a protrusion substantially the shape of a rectangular, isosceles triangle or of an area element similar to this triangle with curved legs. A ground covering element of a second type (42) is obtained by omitting the four protrusions from the ground covering element of the first type. The ground covering element of the second type may be laid together with additional ground covering elements of the second type or in combination with ground covering elements of the first type.

30 Claims, 7 Drawing Sheets

FLOOR COVERING ELEMENT CONSISTING OF ARTIFICIAL STONE MATERIAL AND SET OF FLOOR COVERING ELEMENTS

SUMMARY OF THE INVENTION

Subject matter of the invention is a ground covering element of a first type of artificial stone material, characterized by the following features in combination:

(a) the ground covering element has the basic shape of a square with four basic sides and four corners;

(b) when progressing along the circumference of the ground covering element, there are provided a first basic side having a first engaging profile, a second basic side having a second engaging profile, a third basic side having a third engaging profile, and a fourth basic side having a fourth engaging profile;

(c) each of the four engaging profile is axially symmetric with respect to an axis of symmetry passing through the halving point of the respective basic side and being perpendicular to the respective basic side;

(d) the first engaging profile and the third engaging profile are mirror images of each other, and the second engaging profile and the fourth engaging profile are mirror images of each other;

(e) the first engaging profile is complementary with the second and fourth engaging profile, and the third engaging profile is complementary with the second and fourth engaging profile;

(f) and on each of the four corner regions of the ground covering element there is provided a protrusion having substantially the shape of a rectangular isosceles triangle or of an area element similar to such a triangle with curved legs.

Ground covering elements having the basic shape of a square are known in considerable numbers.

The ground covering element according to the invention distinguishes itself in technically advantageous manner in that—with respect to the not very high standard of known ground covering elements having the basic shape of a square—the geometry of the ground covering element of the first type and the design of the engaging profile have the effect that the ground covering element of the first type permits the production of ground covering composite structures having a high load bearing capacity (or in other words: high safety against unwanted ground covering element displacements under the effects of loads). The protrusions at the corner regions of the ground covering element potentially have a double function; they increase the anchoring effect of the engaging profile and—in accordance with an additional aspect of the invention to be discussed further below may effect a still further technical aspect in addition.

The lively, pleasing appearance of the composite structure also is a positive aspect accompanying the invention.

The description of the present text make numerous references to geometric relationships, e.g. "engaging profile", "mirror image", "engaging profile constituted by a line trace of mutually angularly adjoining, rectilinear sections". All of these statements relate to a representation of the ground covering element in a plan view, i.e. a view from above onto the useful or top side of the ground covering element, as if the same were laid on a base, unless otherwise expressly stated at the particular location. The ground covering element according to the invention preferably is a ground covering element provided to make ground coverings for "outdoor use" or for laying areas in the outside. A particularly preferred field of use of the ground covering element according to the invention is for traffic areas, in particular such areas outdoors, e.g. areas for motor vehicle traffic, areas for bicycle traffic, areas for pedestrian traffic. Particularly typical and preferred are squares, yards, drives, paths, roads, pedestrian areas, loading areas, terraces, parking areas for vehicles, filling stations, commercial traffic areas, industrial traffic areas, factory yards, container sites.

The afore-mentioned "artificial stone material" in most cases is concrete. As a further preferred possibility, brick-like materials are indicated. In general, there are also all materials conceivable having embedded therein additives or fillers in binders (e.g. also plastics) hardening as a function of time, in particular polymer concrete.

The protrusions preferably each have a first portion of their area located outside of their basic line square and a second portion of their area located inside of their basic line square. This corresponds to the statement that, as regards the protrusions, the respective right angle does not coincide with the right angle at the respective corner of the basic line square, but is rotated in relation to the right angle at the corner of the basic line square. With respect to the protrusions, the first part of their area preferably is smaller than the second part of their area. This corresponds to the statement that the said rotation of the protrusions relative to the respective corner of the basic line square is a rotation by an angle different from 90°.

Preferably, the first and third engaging profile each extend throughout substantially outside of the first and third basic lines, respectively, and the second and fourth engaging profile each extend throughout substantially inside of the second and fourth basic lines, respectively. Due to the fact that the ground covering elements of the first type, because of the geometry specified in the introductory paragraph, must be laid in such a manner that, in the completed composite structure, a rotation by 90° results from each ground covering element to each adjacent ground covering element, the afore-mentioned further development has the effect that, when progressing along each laying gap, the laying gap is laterally "offset" after each ground covering element length. This lateral "offset" quite considerably increases the load bearing capacity of the composite structure, as it is no longer the mere engaging profile that is responsible for the mutual anchoring effect of the ground covering elements of the first type.

However, as an alternative it is possible as well to design part of the engaging profile or all of the engaging profile such that they extend partly outside and partly inside of the respective basic line.

The first and third engaging profile preferably each have a recess with respect to a straight line interconnecting the ends of the two protrusions of the respective basic side that are remote from the corners of the square; and the second and fourth engaging profile preferably each have a projection with respect to a straight line interconnecting the ends of the two protrusions of the respective basic side that are remote from the corners of the square. The engaging profile having a recess at the same time may be the afore-mentioned "engaging profile each extending throughout substantially outside of the respective basic line"; the engaging profile having a projection also may be at the same time the afore-mentioned "engaging profile each extending throughout substantially inside of the respective basic line". However, it is also possible to provide these measures in opposite manner, i.e. to have the engaging profile with recess extend so as to form an engaging profile extending inside of the respective basic line, and to have the engaging profile with projection extend so as to form an engaging profile extending throughout outside of the respective basic line.

With respect to the first and third engaging profile, the ends of the two protrusions remote from the corners of the square preferably are located outside of the basic line square; and with respect to the second and fourth engaging profile, the ends of the two protrusions remote from the corners of the square preferably are located inside of the basic line square.

Preferably, the first and third engaging profile each have only one single recess with respect to the straight line interconnecting the ends of the two protrusions of the respective basic line that are remote from the corners of the square; and the second and fourth engaging profile each have only one single projection with respect to the straight line interconnecting the ends of the two projections of the respective basic line that are remote from the corners of the square.

Preferably, the recess (preferably the several recesses, if provided) extends substantially up to the associated basic line; and the projection (preferably the several projections, if provided) extends substantially up to the associated basic line. However, it is possible as an alternative that the recess does not extend up to the associated basic line or beyond this basic line towards the interior of the ground covering element. As an alternative, it is possible as well that the projection does not extend up to the associated basic line or beyond the associated basic line.

With respect to the four protrusions, each protrusion basic line located opposite the respective right angle preferably is in essence a continuation of the course of a partial length of the engaging profile adjoining a protrusion end.

It is pointed out that it is possible, if desired, to provide both a projection and a recess, or also several projections or several recesses, on the straight line interconnecting the ends of the two protrusions of the respective basic side that are remote from the corners of the square.

Preferably, each engaging profile is a line trace of mutually angularly adjoining, rectilinear sections or a curved line trace or a line trace having at least one rectilinear section and at least one curved section. The curvature of the line trace, in the course thereof, may change gradually or abruptly. Transitions from curvature in clockwise direction and curvature in anti-clockwise direction are preferred in addition.

Preferably, in each engaging profile the partial length between the ends of the two protrusions remote from the corners of the square is constituted by two or three or four mutually angularly adjoining, rectilinear sections or by a curved line or by a line trace of at least two rectilinear sections connected via at least one curved section.

Preferably, the ground covering element of the first type is provided with spacer projections on its circumference, with these spacer projections being disregarded in the consideration of the geometric relationships discussed so far in the entire description. However, the latter sentence part does not mean that there would not be embodiments in which, even in consideration of the spacer projections, the aforementioned geometric relationships are present as before. The spacer projections may be of a size in particular for defining narrow gaps of a width of at the most 5 mm between adjacently laid ground covering elements, thereby facilitating laying of the ground covering elements. These "narrow" gaps, having in most cases a width of 3 to 5 mm, are those gaps which normally are present as laying gaps between the ground covering elements in the ground covering and which are normally filled with sand after laying of the ground covering elements. When the ground covering elements have these "small" spacer projections, the laying person during laying can work more easily by using the spacer projections as abutments. On the other hand, the spacer projections in particular may be of a size to define wide gaps of a width of at least 8 mm between adjacently laid ground covering elements, thereby forming efficient water penetration gaps. In case these "larger" spacer projections are provided, relatively wide gaps result between adjacently laid ground covering elements. The gaps are usually also filled with sand or with gravel. By way of these "wide gaps", precipitation water can flow off to the underground in considerably more efficient manner than in case of the "narrow gaps of normal width" between the ground covering elements, so that the area laid no longer needs to be connected to a dewatering drainage system, thereby contributing to the desired enrichment of the ground water. Both with the "smaller" spacer projections and with the "larger" spacer projections, the design can either be such that projections of a respective ground covering element contact locations of the adjacent ground covering elements that are not provided with a projection there, or such that the projections contact locations of the adjacently laid ground covering elements where the latter also have a projection; in this case, each of the projections thus abut each other in pairs. It is to be understood that the projections in this case have a "projecting length" with respect to the other outline of the ground covering element which approximately corresponds to half of the desired gap width; in the first-mentioned case, the "projecting length" of the projections has to correspond approximately to the desired gap width.

It is emphasized that the term "engaging profile" just is supposed to express the function of a positive interengagement or mutual anchoring between two adjacent ground covering elements in the laid state. In particular, it is not supposed to express anything towards a sharp edge design, angular design or angular path of sections of the engaging profile; a curved path e.g. in accordance with a sinusoidal line, of course, constitutes an engaging profile in the sense of the invention as well.

A further subject matter of the invention is a ground covering element of a second type of artificial stone material, characterized in that it has a shape that results by omission of the four protrusions of the ground covering element of the first type described so far. "Omission of a protrusion" means an omission along a line which in essence is a continuation of the path of the adjoining partial length of the respective engaging profile (between the ends of the two protrusions remote from the corners of the square). This provides also a definition as to the line as of which reference is made to a protrusion of the ground covering element of the first type. It is to be understood that all explanations and preferential features described hereinbefore in connection with the ground covering element of the first type are applicable to the ground covering element of the second type as well.

The ground covering element of the second type according to the invention alternatively can also be defined by the presence of the following features in combination:

(a) the ground covering element has the basic shape of a non-square rectangle (i.e. a rectangle of different length and width) with four basic sides and four corners;

(b) when progressing along the circumference of the ground covering element, there are provided a first basic side having a first engaging profile, a second basic side having a second engaging profile, a third basic side having a third engaging profile, and a fourth basic side having a fourth engaging profile;

(c) each of the four engaging profile is axially symmetric with respect to an axis of symmetry passing through the halving point of the respective basic side and being perpendicular to the respective basic side;

(d) the first engaging profile and the third engaging profile are mirror images of each other, and the second engaging profile and the fourth engaging profile are mirror images of each other;

(e) the first engaging profile is complementary with a central partial region of the second and fourth engaging profile, and the third engaging profile is complementary with the central partial region of the second and fourth engaging profile.

Preferably, the first and third engaging profile are located on the shorter sides of the basic side rectangle and each have at least one recess (preferably one recess only) with respect to the basic side rectangle; and the second and fourth engaging profile are located on the longer sides of the basic side rectangle and each have at least one projection (preferably one projection only) with respect to the basic side rectangle.

An additional subject matter of the invention is a set of ground covering elements, characterized in that it comprises ground covering elements of the first type, as described hereinbefore, and ground covering elements of the second type, as described hereinbefore. The set of ground covering elements consists of at least one ground covering element of the first type and one ground covering element of the second type.

In laying the set of ground covering elements of said first type ground covering elements and said second type ground covering elements, there are the following basic possibilities:

a) there is made a more or less regular change, e.g. in alternating manner, however, between a ground covering element of the first type and a ground covering element of the second type;

b) there is a first laying area laid with ground covering elements of the first type, and adjoining the same is a second laying area laid with ground covering elements of the second type.

In the latter laying case, there are water penetration passages formed between the ground covering elements of the second type, which at least in essence have the shape of a small square. In the laying case mentioned first, there is a water penetration passage formed at each location of a corner point of a ground covering element of the second type, with this water penetration passage being at least as large as an "omitted protrusion". A particular characteristic of the set of ground covering elements according to the invention consists in that the ground covering elements of the first type may be laid adjacent each other without any problem, that the ground covering elements of the second type may be laid adjacent each other without any problem, and that in particular also the ground covering elements of the second type may be laid adjacent ground covering elements of the first type without any problem.

It is expressly emphasized that the set of ground covering elements according to the invention may also be composed of ground covering elements of the first type and ground covering elements of the second type which each do not cogently have all features (a) to (f) listed in the summary of the invention. It is sufficient if a sub-amount of features (a) to (f) is present. In particular, the axial symmetry according to feature (c) and/or the mirror image design according to feature (d) and the complementary design according to feature (e), if it relates to part of the engaging profile only, may be dispensed with. A preferred example of a ground covering element of the first type is a ground covering element of the first type in which each of the four engaging profile is as such central symmetric or point-symmetric, in which all of the engaging profile can be made congruent with each other by rotation by 90°, 180° or 270° around a virtual, upright, central axis of rotation, and in which each engaging profile is complementary with the other three engaging profile. The same holds analogously for the ground covering element of the second type.

Still another subject matter of the invention is a ground covering element of a third type of artificial stone material, characterized in that it has a shape resulting from an integral combination of several ground covering elements of the first type or several ground covering elements of the second type.

As an alternative, it is possible as well for the ground covering element of the third type to integrally combine, "in mixed form", at least one ground covering element of the first type and at least one ground covering element of the second type, e.g. one ground covering element of the first type and one ground covering element of the second type. Preferably, exactly two ground covering elements of the first type or two ground covering elements of the second type; or also three ground covering elements of the first type and three ground covering elements of the second type; or still more ground covering elements of the first type or still more ground covering elements of the second type may be combined with each other. In case there are three ground covering elements combined, there is either the possibility of a combination "in a row" or the possibility of a combination "in angular shape", with the latter being preferred.

The ground covering element of the third type preferably has at least one dummy gap in the useful or top side. The dummy gap preferably extends substantially in accordance with the engaging profile pair omitted due to such integral combination.

BRIEF DESCRIPTION OF THE DRAWINGS

The invention will be elucidated in more detail hereinafter by way of embodiments shown in the drawings in which.

DETAILED DESCRIPTION OF THE INVENTION

Figure 1:
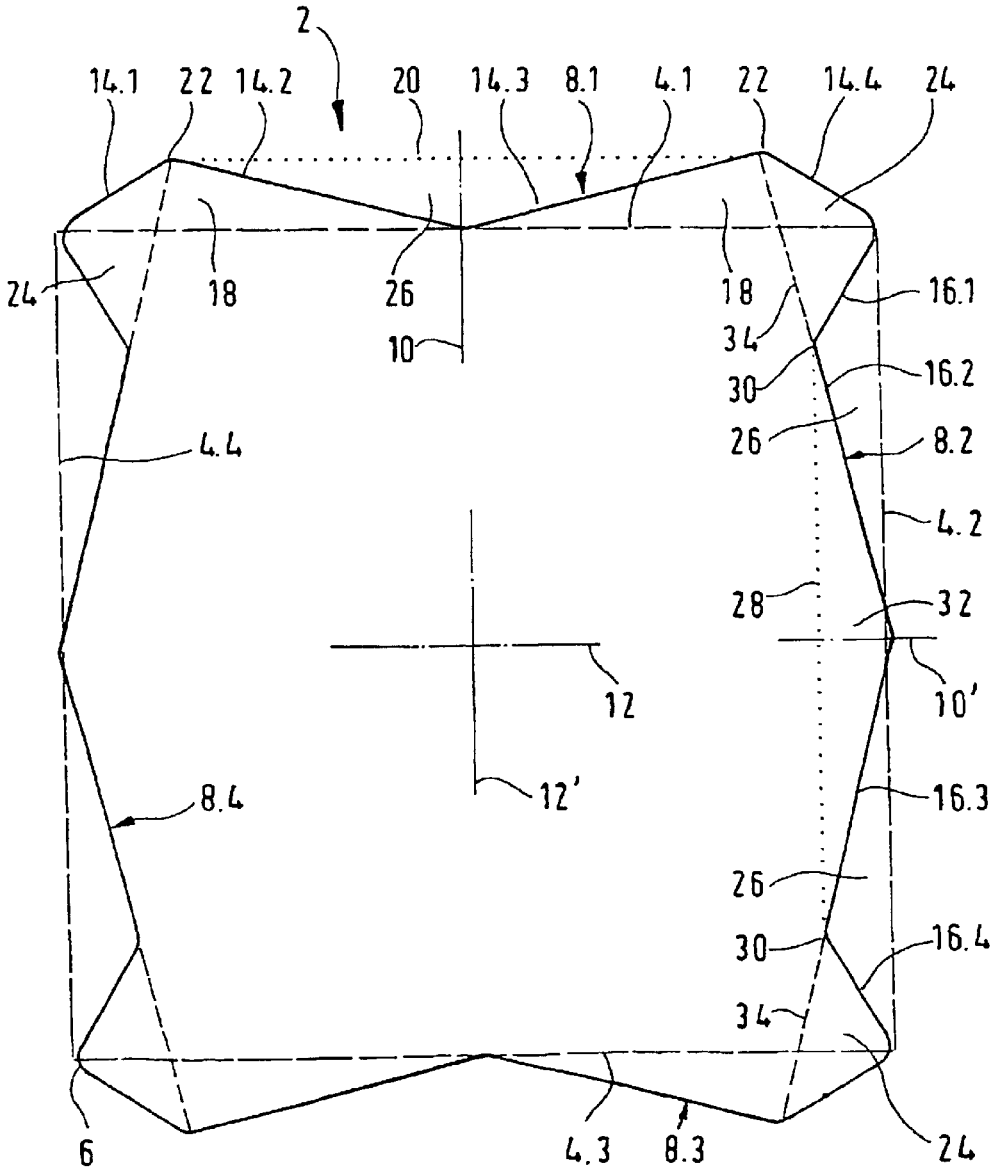
FIG. 1 shows a plan view of a ground covering element of the first type.

The ground covering element of the first type 2 shown in FIG. 1 has the basic shape of a square illustrated by four basic sides 4.1 to 4.4 shown in broken lines and meeting in four corners 6. When moving along the outline of the ground covering element 2 in clockwise direction, there is a succession of the first basic side 4.1 having a first engaging profile 8.1, the second basic side 4.2 having a second engaging profile 8.2, the third basic side 4.3 having a third engaging profile 8.3, and the fourth basic side 4.4 having a fourth engaging profile 8.4.

Each of the four engaging profile 8.1 to 8.4 is axially symmetric with respect to an axis of symmetry extending through the halving point of the associated basic side and perpendicular to the respective basic side. This axis of symmetry 10 is illustrated for the first engaging profile 8.1.

The first engaging profile 8.1 and the third engaging profile 8.3 are mirror images of each other or—in other words—axially symmetric with each other along the axis of symmetry 12. The first engaging profile 8.1 is a line trace of mutually angularly adjoining rectilinear sections 14.1 to 14.4, with the second section 14.2 and the third section 14.3 each being considerably longer than the first section 14.1 and the fourth section 14.4, respectively. The second section 14.2 and the third section 14.3 each extend at a smaller angle relative to the respective basic side 4.1 than the first section 14.1 and the fourth section 14.4. Due to the mirror image design with respect to axis 12, the third engaging profile 8.3 thus has been described completely as well.

The second engaging profile 8.2, too, is a line trace with "kinked locations" and is inherently axially symmetric with respect to the axis of symmetry 10' (which coincides with axis of symmetry 12). Progressing in clockwise direction in FIG. 1, the second engaging profile 8.2 has a first section 16.1, a second section 16.2, a third section 16.3 and a fourth section 16.4. The second section 16.2 and the third section 16.3 each are clearly longer than the first section 16.1 and the fourth section 16.4. As regards the angles relative to the respective basic line 4.2, the same applies as in case of the first engaging profile 8.1.

The fourth engaging profile 8.4 is a mirror image of the second engaging profile 8.2 or—in other words axially symmetric with respect to the second engaging profile 8.2 along an axis of symmetry 12' that coincides with the axis of symmetry 10. Due to this symmetry, the fourth engaging profile 8.4 thus has been described fully as well.

In the first engaging profile 8.1 and the third engaging profile 8.3, all sections are located outside of the associated basic line 4.1 and 4.3, respectively, so that there are formed two projections with respect to the associated basic line 4.1 and 4.3, respectively. However, when considering the relation to a straight connecting line 20 (illustrated as dotted line) between the ends 22 of the associated two protrusions 24 (to be described in more detail further below), which ends are remote from the corners 6 of the square, the first engaging profile 8.1 just constitutes one single recess 26. The situation is completely analogous for the third engaging profile 8.3.

As regards the second engaging profile 8.2, all sections 16.1 to 16.4 are inside of the associated basic line 4.2. There are formed two recesses 26 with respect to the second basic line 4.2. When considering the straight line 28 (illustrated as dotted line) between the ends 30 of the two associated protrusions 24 remote from the corners 6 of the square, there is formed just one single projection 32 with respect to said line 28.

It is immediately apparent that the first engaging profile 8.1 is complementary both with the second engaging profile 8.2 and with the fourth engaging profile 8.4. In other words: An additional ground covering element of the first type 2, upon anti-clockwise rotation thereof by 90°, may be applied to the illustrated ground covering element 2 from the right-hand side; an additional ground covering element of the second type, upon clockwise rotation by 90°, may be applied to the illustrated ground covering element 2 from the left-hand side. A further ground covering element of the first type 2, upon rotation by 90° either in clockwise or in anti-clockwise direction, may be applied to the illustrated ground covering element 2 from below, as the third engaging profile 8.3 is complementary both with the second engaging profile 8.2 and with the fourth engaging profile 8.4. When extending, in the second engaging profile 8.2, the second section 16.2 towards the left and the third section 16.3 towards the right, each up to the intersection with the first engaging profile 8.1 and the third engaging profile 8.3, respectively, as shown by broken lines 34, area elements in the form of rectangular isosceles triangles are located outside of each of the particular lines 34. Each of these area elements is referred to as a protrusion 24. The situation is completely analogous for the fourth engaging profile 8.4.

Figure 9:
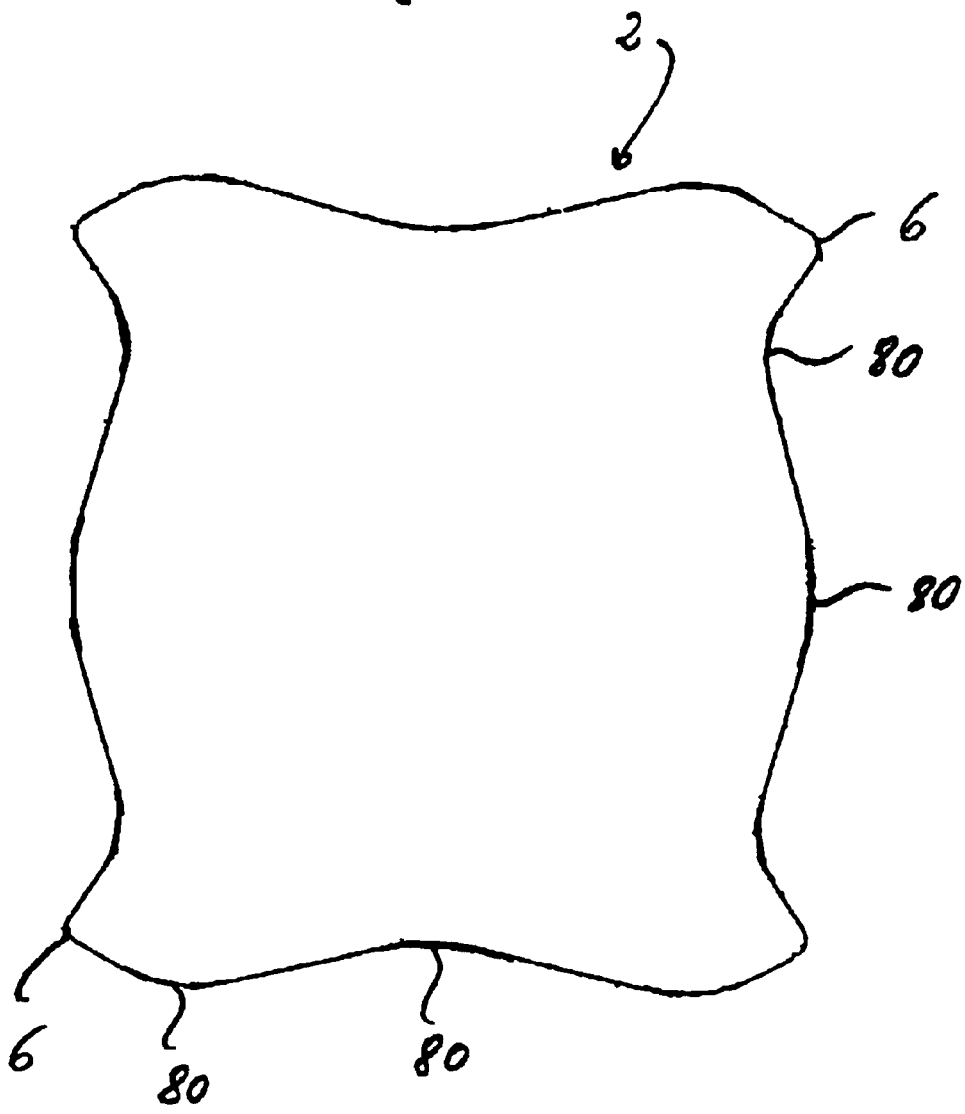
FIG. 9 shows a plan view of another embodiment of a ground covering element of the first type.

A modification of the ground covering element 2 shown in FIG. 1 is easily conceivable in which all "kink locations" of the engaging profile are replaced by rounded locations. Each engaging profile then is constituted by a line trace consisting of rectilinear sections and curved sections. Such a modified ground covering element is shown in FIG. 9, the curved sections being designated by referenced number 80.

Figure 2:
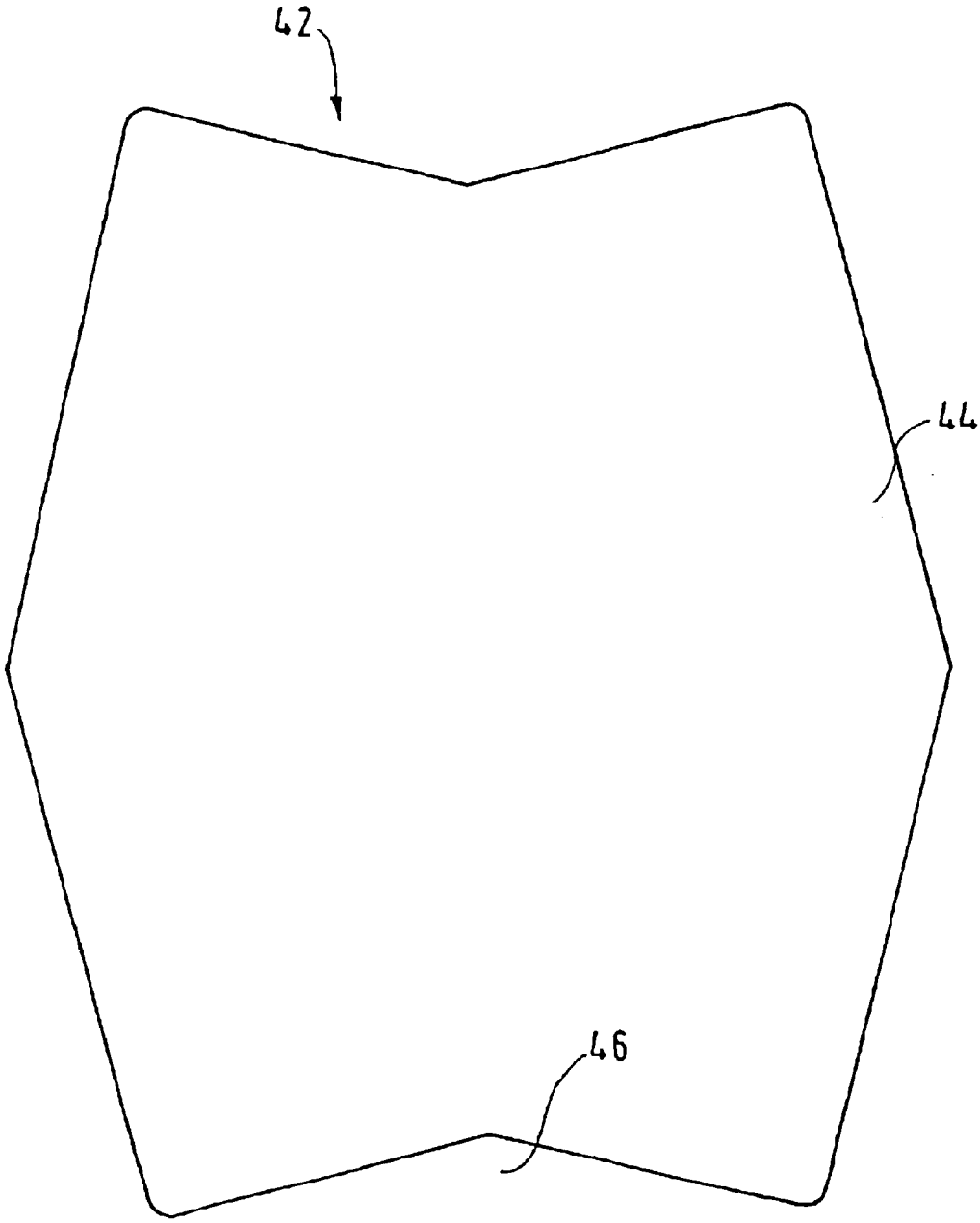
FIG. 2 shows a plan view of a ground covering element of the second type.

The ground covering element of the second type 42 as shown in FIG. 2 is conceivable best to have been created by "cutting off", and thus omitting, the four protrusions 24 from the ground covering element of the first type 2 according to FIG. 1 along the lines 34. The ground covering element of the second type 42 thus has a very simple geometry with one triangular projection 44 on each longitudinal side and one recess 46 on each transverse side. The geometric relationships indicated in the Summary of the Invention under (c), (d) and (e) hold for the ground covering element of the second type 42 as well as the first type 2, with the word "complementary" now being understood in a slightly modified meaning, which will be described in more detail below.

Figure 3:
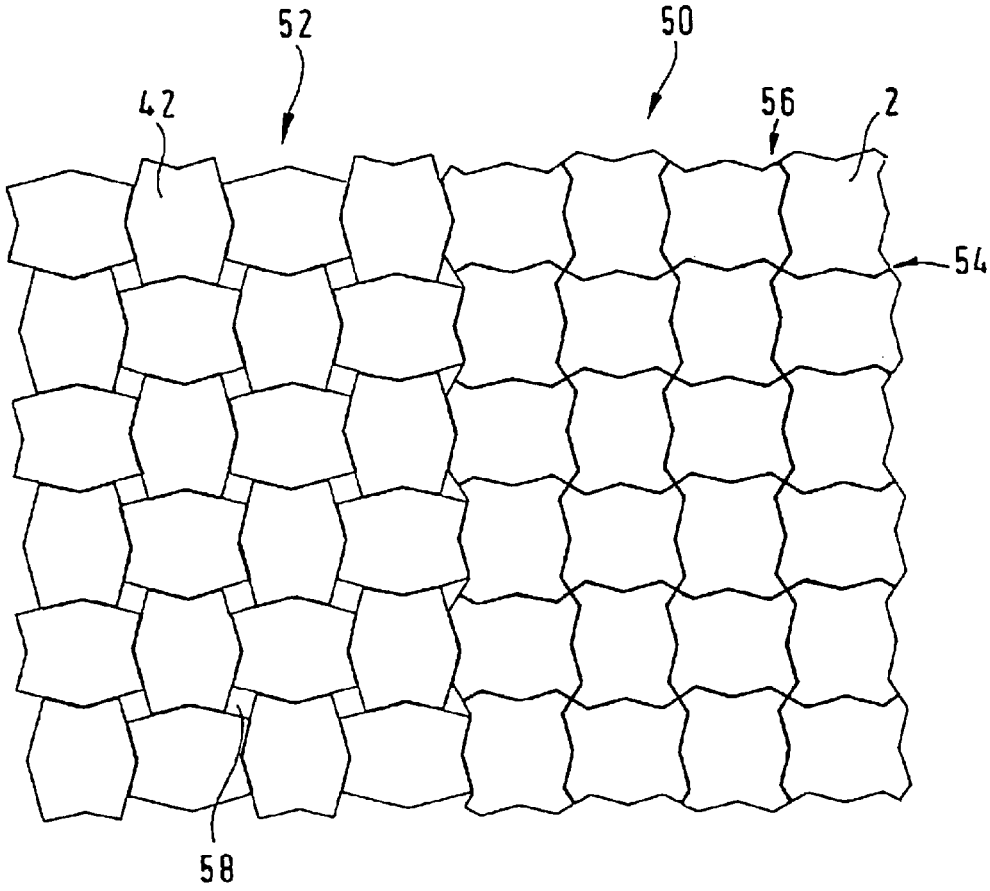
FIG. 3 shows a plan view of a ground covering formed of ground covering elements of the first type according to FIG. 1 and of ground covering elements of the second type according to FIG. 2.

FIG. 3, in the right-hand half thereof, shows a part 50 of a ground covering made of ground covering elements of the first type and, in the left-hand half thereof, shows a part 52 of a ground covering made of ground covering elements of the second type 42. The ground covering part 50 makes clear that the ground covering elements of the first type 2 are all laid in alternating orientation both in horizontal row direction and in vertical row direction; i.e. assuming a first engaging profile 8.1 to be located at the top in a ground covering element 2 in consideration, the second engaging profile 8.2 (or, in corresponding manner, the fourth engaging profile 8.4) of all four adjacently laid ground covering elements 2 is located at the top in FIG. 3. An important characteristic of the covering part 50 is thus revealed, namely that, progressing along a horizontal laying gap 54 or a vertical laying gap 56, the laying gap is laterally "offset" a certain distance following each ground covering element 2. Due to this "offset", the anchoring effect between the ground covering elements of the first type 2 is enhanced.

In case of the covering part 52 shown in the left-hand half in FIG. 3, ground covering elements of the second type 42 are laid adjacent each other. Here, too, it can be seen that adjacent ground covering elements 42 are laid rotated by 90° each. A distinct lateral "offset" of the laying gaps can be seen here as well.

Due to the omitted protrusions 24, the covering part 52 has a completely different appearance as compared to covering part 50. In addition thereto, water penetration passages 58 are formed, each in the form of a small square surrounded by four adjacent ground covering elements of the second type 42.

It can be seen that, in case of the second ground covering part 52, the "contact length" between each pair of adjacently laid ground covering elements of the second type 42 is shorter than in case of the first ground covering part 50. On the longitudinal sides of the ground covering elements 42, there is only part of the projection 44 utilized as engaging profile, whereas on the transverse side the entire respective recess 46 is used for engagement.

Particularly remarkable is the manner in which—at the boundary between first covering part 50 and second covering part 52—the ground covering elements of the second type 42 can be applied or laid adjacent the ground covering elements of the first type 2 without any problem, namely the recess 46 of one transverse side of a ground covering element of the second type 42 fits against the projection of a fourth engaging profile 8.4 of a ground covering element of the second type 2, and the central part of a projection 44 of a longitudinal side of a ground covering element of the second type 42 fits against the recess of a first engaging profile 8.1 of a ground covering element of the first type 2.

It is pointed out that the unproblematic placeability of ground covering elements of the second type 42 against ground covering elements of the first type 2 may not only be used for the transition between a ground covering part 50 and another ground covering part 52, as illustrated in FIG. 3, but that, especially also in the right-hand ground covering part 50 in FIG. 3, every other, i.e. every second, ground covering element of the first type 2 may be replaced with a ground covering element of the second type 42 (alternatively, of course, also in lesser or higher numbers, in regularly distributed or irregularly distributed manner). In case every other ground covering element of the first type 2 is replaced, there are water penetration passages 58 formed, having the size of two omitted protrusions 24.

Figure 4:
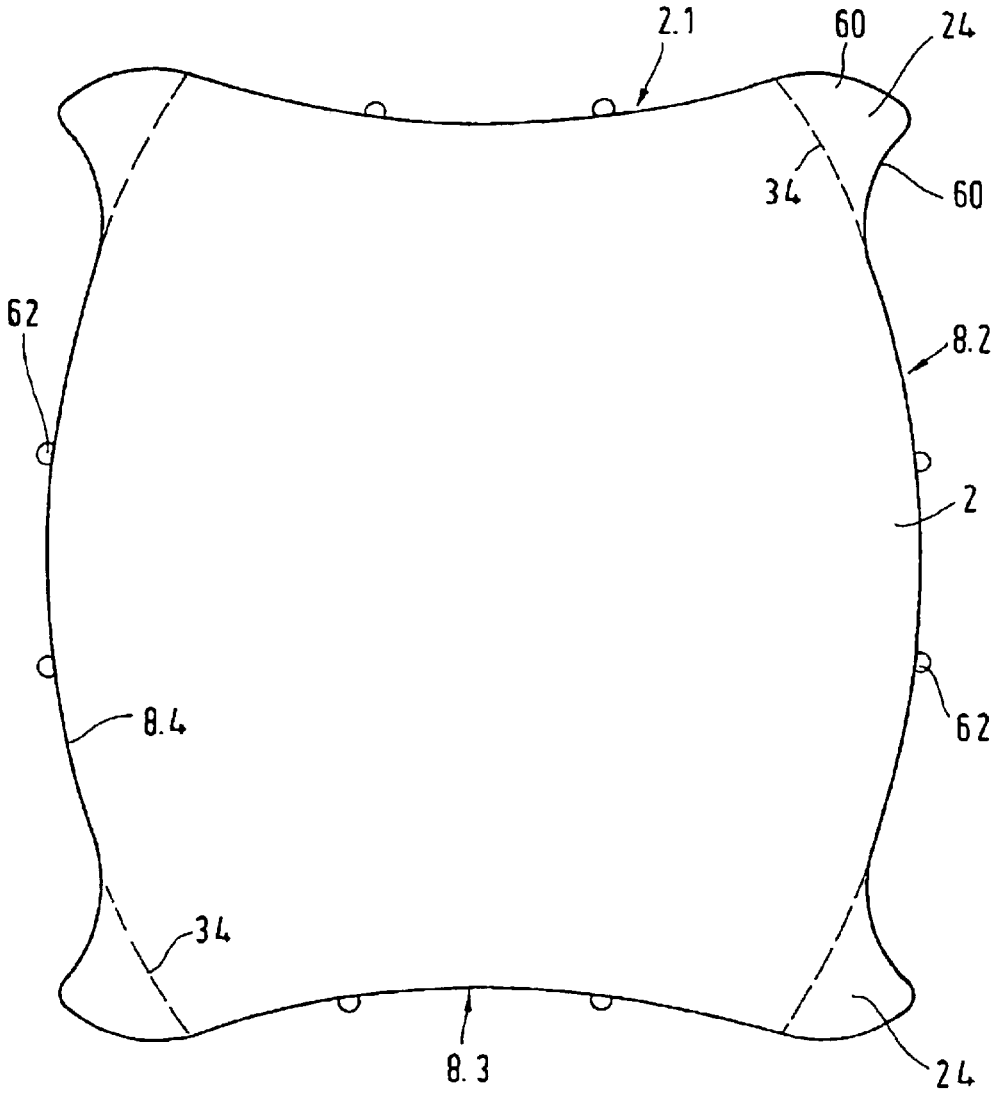
FIG. 4 shows a plan view of another embodiment of a ground covering element of the first type.

The ground covering element of the first type 2 shown in FIG. 4 has four engaging profile 8.1, 8.2, 8.3, 8.4, each having the shape of a curved line trace. Otherwise, the geometric relationships are analogous to those of the ground covering element 2 of FIG. 1. The "separating lines" 34, shown in broken lines, now are curved as well, being continuations of the respective adjacent curved projections 32. The protrusions 24 are area elements similar to the area elements of FIG. 1, but having curved legs 60.

Figure 5:
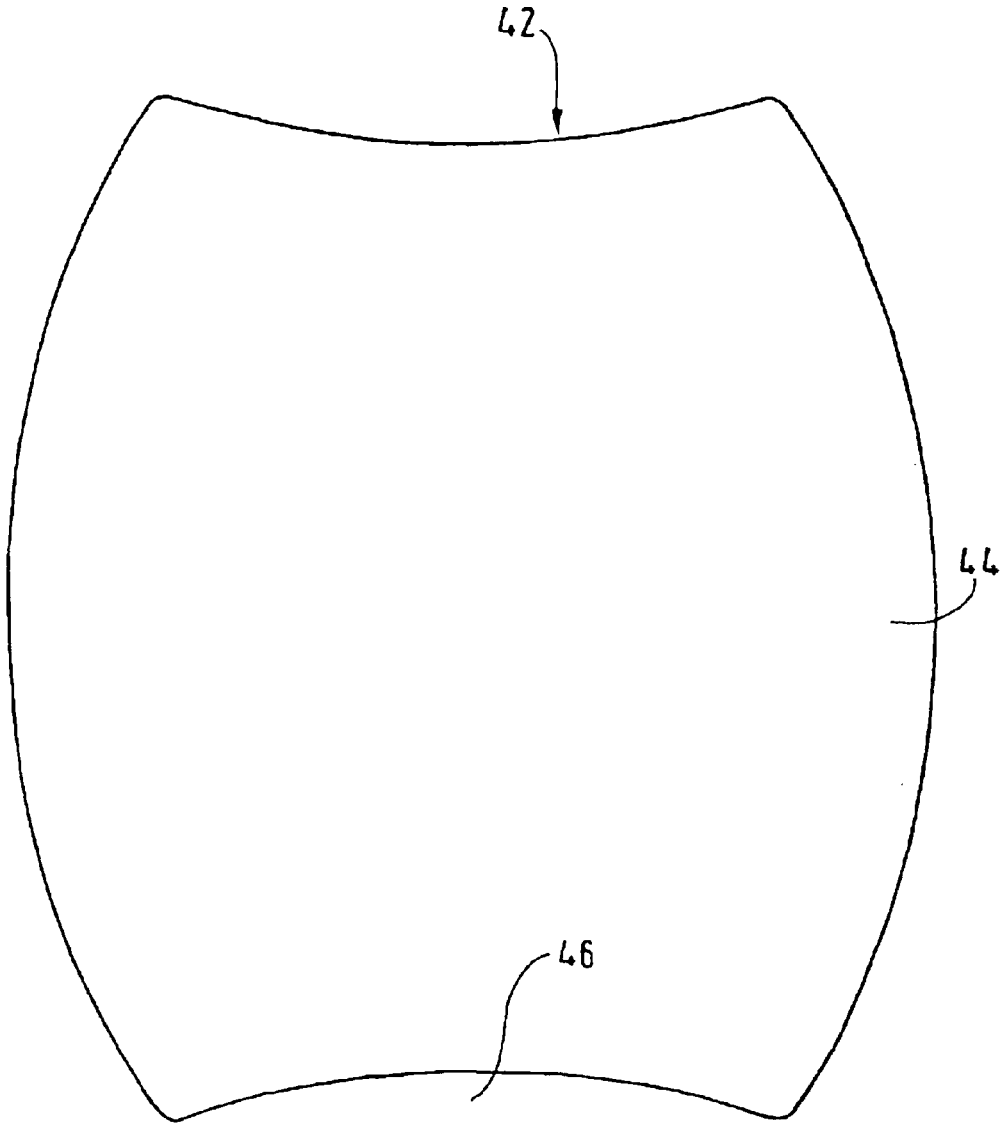
FIG. 5 shows a plan view of another embodiment of a ground covering element of the second type.

FIG. 5 illustrates a ground covering element of the second type 42, which is created by omission of the protrusions 24 from the ground covering element of the first type 2 according to FIG. 4.

The ground covering elements 2 and 42, respectively, of FIGS. 4 and 5 may be laid in completely analogous manner as described by way of FIG. 3. The water penetration passages 58 then have a configuration similar to a small square, but with sides that are slightly curved towards the inside of the square.

FIGS. 4 and 5 illustrate furthermore what ground covering elements 2 and 42, respectively, with spacer projections 62 on the circumference could look like.

Figure 6:
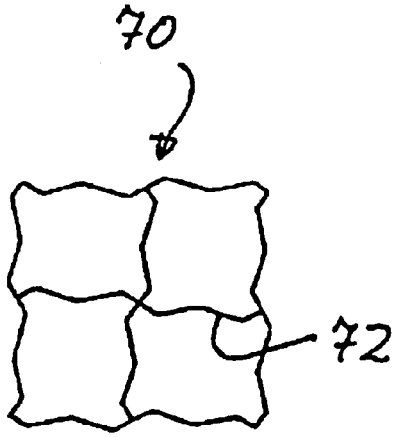
FIG. 6 shows a plan view of a ground covering element of a third type.

FIG. 6 illustrates a ground covering element of the third type 70, which has a shape resulting from an integral combination of four ground covering elements of the first type 2, as shown in FIG. 1. The combination is made such that a ground covering element 70 with the basic shape of a square results again, however with an area that is four times as large. The ground covering element 70 has dummy gaps 72, i.e. gaps extending to a certain depth into the ground covering element 70 from the top side, which run in accordance with the engaging profile pairs 8.1/8.2 etc. omitted due the integral combination of the ground covering elements of the first type. Consequently, the laid ground covering elements of the third type 70 give the optical appearance as if the area were laid with correspondingly smaller ground covering elements of the first type.

When looking at FIG. 3, right-hand half, there may easily be "cut out" other ground covering elements of the third type, which e.g. are an integral combination of two ground covering elements of the first type, or an integral combination of three ground covering elements of the first type, or an integral combination of four ground covering elements of the first type. If there is an integral combination made of three ground covering elements of the first type, it is possible to choose either an arrangement "in a row" or an arrangement "around the corner" or "in angular form". In order to be able to cover an area then, two different ground covering elements of the third type have to be used, namely one having one longitudinally oriented component (=ground covering element of the first type) and two transversely oriented components (=ground covering elements of the first type), and the other ground covering element of the third type having two longitudinally oriented components and one transversely oriented component. In uniting four ground covering elements of the first type, an arrangement in T-shape may be provided as an alternative to FIG. 6.

Figure 7:
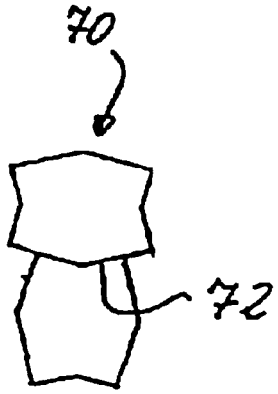
FIG. 7 shows another embodiment of a ground covering element of the third type.

FIG. 7 shows a ground covering element of the third type 70, having a configuration resulting from an integral combination of two ground covering elements of the second type 42, as shown in FIG. 2. Here, too, there is present a dummy gap 72 extending in accordance with the engaging profile pair omitted due to such combination.

When looking at FIG. 3, left-hand half, other ground covering elements of the third type, consisting of more than two ground covering elements of the second type, are easily conceivable as well.

Figure 8:
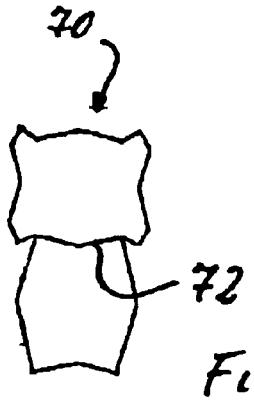
FIG. 8 shows still another embodiment of a ground covering element of the third type.

FIG. 8 shows a ground covering element of the third type 70, having a configuration resulting from an integral combination of one ground covering element of the first type 2, as shown in FIG. 9, and one ground covering element of the second type 42, as shown in FIG. 2. There, too, there is present a dummy gap 72 extending in accordance with the engaging profile pair omitted due to such combination.

It is emphasized that ground covering elements of the third type 70 are also possible without the illustrated dummy gaps 72, or with dummy gaps that do not extend in accordance with the engaging profile pairs that were omitted due to the integral combination.

What is claimed is:

1. A ground covering element of a first type, composed of artificial stone material, having the basic shape of a square with a circumference formed in sequence by first, second, third and fourth basic sides, and having a first corner at the intersection of the first and second basic sides, a second corner at the intersection of the second and third basic sides, a third corner at the intersection of the third and fourth basic sides, and a fourth corner at the intersection of the fourth and first basic sides, comprising:

first, second, third and fourth engaging profiles extending along the first, second, third and fourth basic sides respectively, wherein:

(a) each of said engaging profiles is axially symmetric with respect to an axis of symmetry passing through a midpoint thereof and perpendicular to the associated basic side;

(b) said first and third engaging profiles are mirror images of each other, and said second and fourth engaging profiles are mirror images of each other;

(c) said first and third engaging profiles each extend completely outside of the first and third basic sides respectively, and said second and fourth engaging profiles each extend completely inside of the second and fourth basic sides respectively;

(d) said first and third engaging profiles are complementary with said second and fourth engaging profiles;

(e) said first and second engaging profiles form a first protrusion at the first corner of the square, said second and third engaging profiles form a second protrusion at the second corner of the square, said third and fourth engaging profiles form a third protrusion at the third corner of the square, and said fourth and first engaging profiles form a fourth protrusion at the fourth corner of the square; each of said protrusions has substantially the shape of a rectangular isosceles triangle or of an area similar to such a triangle with curved legs; and the vertex of each of said first, second, third and fourth protrusions associated with a right angle of said rectangular isosceles triangle is located at the first, second, third and fourth corners respectively of the square;

(f) said first engaging profile has a recess with respect to a straight line between those vertices of said fourth and first protrusions that are remote from the vertices associated with the right angle and form part of said first engaging profile, and said third engaging profile has a recess with respect to a straight line between those vertices of said second and third protrusions that are remote from the vertices associated with the right angle and form part of said third engaging profile; and (g) said second engaging profile has a projection with respect to a straight line between those vertices of said first and second protrusions that are remote from the vertices associated with the right angle and form part of said second engaging profile, and said fourth engaging profile has a projection with respect to a straight line between those vertices of said third and fourth protrusions that are remote from the vertices associated with the right angle and form part of said fourth engaging profile.

2. A ground covering element according to claim 1 wherein the recesses of said first and third engaging profiles extend substantially to their associated basic sides, and the projections of said second and fourth engaging profiles extend substantially to their associated basic sides.

3. A ground covering element according to claim 1 wherein said first and third engaging profiles each have only one recess with respect to their respective straight lines, and said second and fourth engaging profiles each have only one projection with respect to their respective straight lines.

4. A ground covering element according to claim 1 wherein the base of the rectangular isosceles triangle opposite the right angle of each of said protrusions is a continuation of a portion of a respective engaging profile adjacent the protrusion.

5. A ground covering element according to claim 1 wherein each engaging profile is a line trace of mutually angularly adjoining, rectilinear sections, or a curved line trace, or a line trace having at least one rectilinear section and at least one curved section.

6. A ground covering element according to claim 1 wherein, in each engaging profile, a portion between adjacent protrusions is constituted by two or three or four mutually angularly adjoining, rectilinear sections, or by a curved line trace, or by a line trace of at least two rectilinear sections connected via at least one curved section.

7. A ground covering element according to claim 1 which further comprises spacer projections distributed about the circumference thereof, said spacer projections being disregarded in considering the geometric relationships defined by claim 1.

8. A ground covering element of a third type, of artificial stone material, comprising an integral combination of several ground covering elements of the first type defined by claim 1.

9. A ground covering element according to claim 8 having at least one dummy gap extending substantially in accordance with engaging profile pairs omitted due to such integral combination.

10. A ground covering element of a second type, composed of artificial stone material, having the basic shape of a square with a circumference formed in sequence by first, second, third and fourth basic sides, and having a first corner at the intersection of the first and second basic sides, a second corner at the intersection of the second and third basic sides, a third corner at the intersection of the third and fourth basic sides, and a fourth corner at the intersection of the fourth and first basic sides, comprising:

first, second, third and fourth engaging profiles extending along the first, second, third and fourth basic sides respectively, wherein:

(a) each of said engaging profiles is axially symmetric with respect to an axis of symmetry passing through a midpoint thereof and perpendicular to the associated basic side;

(b) said first and third engaging profiles are mirror images of each other, and said second and fourth engaging profiles are mirror images of each other;

(c) said first and third engaging profiles each extend substantially outside of the first and third basic sides respectively, and said second and fourth engaging profiles each extend substantially inside of the second and fourth basic sides respectively;

(d) said first and third engaging profiles are complementary with said second and fourth engaging profiles;

(e) said first and second engaging profiles form a first protrusion at the first corner of the square, said second and third engaging profiles form a second protrusion at the second corner of the square, said third and fourth engaging profiles form a third protrusion at the third corner of the square, and said fourth and first engaging profiles form a fourth protrusion at the fourth corner of the square; each of said protrusions has substantially the shape of a rectangular isosceles triangle or of an area similar to such a triangle with curved legs; and the vertex of each of said first, second, third and fourth protrusions associated with a right angle of said rectangular isosceles triangle is located at the first, second, third and fourth corners respectively of the square;

(f) said first engaging profile has a recess with respect to a straight line between those vertices of said fourth and first protrusions that are remote from the vertices associated with the right angle and form part of said first engaging profile, and said third engaging profile has a recess with respect to a straight line between those vertices of said second and third protrusions that are remote from the vertices associated with the right angle and form part of said third engaging profile; and (g) said second engaging profile has a projection with respect to a straight line between those vertices of said first and second protrusions that are remote from the vertices associated with the right angle and form part of said second engaging profile, and said fourth engaging profile has a projection with respect to a straight line between those vertices of said third and fourth protrusions that are remote from the vertices associated with the right angle and form part of said fourth engaging profile;

(h) but with the four said protrusions omitted.

11. A set of ground covering elements including ground covering elements of a first type, composed of artificial stone material, and having the basic shape of a square with a circumference formed in sequence by first, second, third and fourth basic sides, and having a first corner at the intersection of the first and second basic sides, a second corner at the intersection of the second and third basic sides, a third corner at the intersection of the third and fourth basic sides, and a fourth corner at the intersection of the fourth and first basic sides, comprising:

(1) first, second, third and fourth engaging profiles extending along the first, second, third and fourth basic sides respectively, wherein:

(a) each of said engaging profiles is axially symmetric with respect to an axis of symmetry passing through a midpoint thereof and perpendicular to the associated basic side;

(b) said first and third engaging profiles are mirror images of each other, and said second and fourth engaging profiles are mirror images of each other;

(c) said first and third engaging profiles each extend substantially outside of the first and third basic sides respectively, and said second and fourth engaging profiles each extend substantially inside of the second and fourth basic sides respectively;

(d) said first and third engaging profiles are complementary with said second and fourth engaging profiles;

(e) said first and second engaging profiles form a first protrusion at the first corner of the square, said second and third engaging profiles form a second protrusion at the second corner of the square, said third and fourth engaging profiles form a third protrusion at the third corner of the square, and said fourth and first engaging profiles form a fourth protrusion at the fourth corner of the square, each of said protrusions has substantially the shape of a rectangular isosceles triangle or of an area similar to such a triangle with curved legs; and the vertex of each of said first, second, third and fourth protrusions associated with a right angle of said rectangular isosceles triangle is located at the first, second, third and fourth corners respectively of the square;

(f) said first engaging profile has a recess with respect to a straight line between those vertices of said fourth and first protrusions that are remote from the vertices associated with the right angle and form part of said first engaging profile, and said third engaging profile has a recess with respect to a straight line between those vertices of said second and third protrusions that are remote from the vertices associated with the right angle and form part of said third engaging profile; and (g) said second engaging profile has a projection with respect to a straight line between those vertices of said first and second protrusions that are remote from the vertices associated with the right angle and form part of said second engaging profile, and said fourth engaging profile has a projection with respect to a straight line between those vertices of said third and fourth protrusions that are remote from the vertices associated with the right angle and form part of said fourth engaging profile; and including (2) ground covering elements of the second type, composed of artificial stone material, as defined by claim 10.

12. A ground covering element of a third type, of artificial stone material, comprising an integral combination of several ground covering elements of the second type defined by claim 10.

13. A ground covering element according to claim 12 having at least one dummy gap extending substantially in accordance with engaging profile pairs omitted due to such integral combination.

14. A ground covering element according to claim 10 wherein the recesses of said first and third engaging profiles extends substantially to their associated basic sides, and the projections of said second and fourth engaging profiles extends substantially to their associated basic sides.

15. A ground covering element according to claim 10 wherein said first and third engaging profiles each have only one recess with respect to their respective straight lines, and said second and fourth engaging profiles each have only one projection with respect to their respective straight lines.

16. A ground covering element according to claim 10 wherein each of said four omitted protrusions has a baseline opposite the right angle of the respective protrusion, each of said baselines being a continuation of a portion of said respective engaging profile adjacent the omitted protrusion.

17. A ground covering element according to claim 10 wherein each engaging profile is a line trace of mutually angularly adjoining, rectilinear sections, or a curved line trace, or a line trace having at least one rectilinear section and at least one curved section.

18. A ground covering element according to claim 10 wherein, in each engaging profile, a portion between adjacent spaces is constituted by two or three or four mutually angularly adjoining, rectilinear sections, or by a curved line trace, or by a line trace of at least two rectilinear sections connected via at least one curved section.

19. A ground covering element according to claim 10 which further comprises spacer projections distributed about the circumference thereof, said spacer projections being disregarded in considering the geometric relationships defined by claim 10.

20. The ground covering element of the second type according to claim 10 wherein said first and third engaging profiles each extend completely outside of the first and third basic sides respectively, and said second and fourth engaging profiles each extend completely inside of the second and fourth basic sides lines respectively.

21. A ground covering element of a first type, composed of artificial stone material, having the basic shape of a square with a circumference formed in sequence by first, second, third and fourth basic sides, and having a first corner at the intersection of the first and second basic sides, a second corner at the intersection of the second and third basic sides, a third corner at the intersection of the third and fourth basic sides, and a fourth corner at the intersection of the fourth and first basic sides, comprising:

first, second, third and fourth engaging profiles extending along the first, second, third and fourth basic sides respectively, wherein:

(a) each of said engaging profiles is axially symmetric with respect to an axis of symmetry passing through a midpoint thereof and perpendicular to the associated basic side;

(b) said first and third engaging profiles are mirror images of each other, and said second and fourth engaging profiles are mirror images of each other;

(c) said first and third engaging profiles each extend substantially outside of the first and third basic sides respectively, and said second and fourth engaging profiles each extend substantially inside of the second and fourth basic sides respectively;

(d) said first and third engaging profiles are complementary with said second and fourth engaging profiles;

(e) said first and second engaging profiles form a first protrusion at the first corner of the square, said second and third engaging profiles form a second protrusion at the second corner of the square, said third and fourth engaging profiles form a third protrusion at the third corner of the square, and said fourth and first engaging profiles form a fourth protrusion at the fourth corner of the square; each of said protrusions has substantially the shape of a rectangular isosceles triangle or of an area similar to such a triangle with curved legs; and the vertex of each of said first, second, third and fourth protrusions associated with a right angle of said rectangular isosceles triangle is located at the first, second, third and fourth corners respectively of the square;

(f) said first engaging profile has a recess with respect to a straight line between those vertices of said fourth and first protrusions that are remote from the vertices associated with the right angle and form part of said first engaging profile, and said third engaging profile has a recess with respect to a straight line between those vertices of said second and third protrusions that are remote from the vertices associated with the right angle and form part of said third engaging profile; and (g) said second engaging profile has a projection with respect to a straight line between those vertices of said first and second protrusions that are remote from the vertices associated with the right angle and form part of said second engaging profile, and said fourth engaging profile has a projection with respect to a straight line between those vertices of said third and fourth protrusions that are remote from the vertices associated with the right angle and form part of said fourth engaging profile; and (h) wherein the base of the rectangular isosceles triangle opposite the right angle of each of said protrusions is a continuation of a portion of a respective engaging profile adjacent the protrusion.

22. A ground covering element according to claim 21 wherein the recesses of said first and third engaging profiles extend substantially to their associated basic sides, and the projections of said second and fourth engaging profiles extend substantially to their associated basic sides.

23. A ground covering element according to claim 21 wherein said first and third engaging profiles each have only one recess with respect to their respective straight lines, and said second and fourth engaging profiles each have only one projection with respect to their respective straight lines.

24. A ground covering element according to claim 21 wherein each engaging profile is a line trace of mutually angularly adjoining, rectilinear sections, or a curved line trace, or a line trace having at least one rectilinear section and at least one curved section.

25. A ground covering element according to claim 21 wherein, in each engaging profile, a portion between adjacent protrusions is constituted by two or three or four mutually angularly adjoining, rectilinear sections, or by a curved line trace, or by a line trace of at least two rectilinear sections connected via at least one curved section.

26. A ground covering element according to claim 21 which further comprises spacer projections distributed about the circumference thereof, and spacer projections being disregarded in the consideration of geometric relationships mentioned in claim 21.

27. A ground covering element of a third type, of artificial stone material, comprising an integral combination of several ground covering elements of the first type defined by claim 21.

28. A ground covering element according to claim 27 having at least one dummy gap extending substantially in accordance with engaging profile pairs omitted due to such integral combination.

29. A set of ground covering elements of a third type, composed of artificial stone material, comprising and an integral combination of at least one ground covering element of a first type having the basic shape of a square with a circumference formed in sequence by first, second, third and fourth basic sides, and having a first corner at the intersection of the first and second basic sides, a second corner at the intersection of the second and third basic sides, a third corner at the intersection of the third and fourth basic sides, and a fourth corner at the intersection of the fourth and first basic sides, comprising:

(1) first, second, third and fourth engaging profiles extending along the first, second, third and fourth basic sides respectively, wherein:

(a) each of said engaging profiles is axially symmetric with respect to an axis of symmetry passing through a midpoint thereof and perpendicular to the associated basic side;

(b) said first and third engaging profiles are mirror images of each other, and said second and fourth engaging profiles are mirror images of each other;

(c) said first and third engaging profiles each extend substantially outside of the first and third basic sides respectively, and said second and fourth engaging profiles each extend substantially inside of the second and fourth basic sides respectively;

(d) said first and third engaging profiles are complementary with said second and fourth engaging profiles;

(e) said first and second engaging profiles form a first protrusion at the first corner of the square, said second and third engaging profiles form a second protrusion at the second corner of the square, said third and fourth engaging profiles form a third protrusion at the third corner of the square, and said fourth and first engaging profiles form a fourth protrusion at the fourth corner of the square, each of said protrusions has substantially the shape of a rectangular isosceles triangle or of an area similar to such a triangle with curved legs; and the vertex of each of said first, second, third and fourth protrusions associated with a right angle of said rectangular isosceles triangle is located at the first, second, third and fourth corners respectively of the square;

(f) said first engaging profile has a recess with respect to a straight line between those vertices of said fourth and first protrusions that are remote from the vertices associated with the right angle and form part of said first engaging profile, and said third engaging profile has a recess with respect to a straight line between those vertices of said second and third protrusions that are remote from the vertices associated with the right angle and form part of said third engaging profile; and (g) said second engaging profile has a projection with respect to a straight line between those vertices of said first and second protrusions that are remote from the vertices associated with the right angle and form part of said second engaging profile, and said fourth engaging profile has a projection with respect to a straight line between those vertices of said third and fourth protrusions that are remote from the vertices associated with the right angle and form part of said fourth engaging profile; and (2) at least one ground covering elements of the second type defined by claim 10.

30. A set of ground covering elements according to claim 29 having at least one dummy gap extending substantially in accordance with engaging profile pairs omitted due to such integral combination.

* * * * *